United States Patent [19]

Hadano et al.

[11] Patent Number: 4,873,827

[45] Date of Patent: Oct. 17, 1989

[54] STEAM TURBINE PLANT

[75] Inventors: Yoshikazu Hadano; Eiji Tsunoda, both of Kanagawa; Ichiro Kajigaya, Chiba, all of Japan

[73] Assignee: Electric Power Research Institute, Palo Alto, Calif.

[21] Appl. No.: 251,177

[22] Filed: Sep. 30, 1988

[30] Foreign Application Priority Data

Sep. 30, 1987 [JP] Japan ..... 62-244037
Sep. 30, 1987 [JP] Japan ..... 62-244038
Sep. 30, 1987 [JP] Japan ..... 62-244039

[51] Int. Cl.[4] ..... F01K 13/02

[52] U.S. Cl. ..... 60/646; 60/653; 60/654; 60/679

[58] Field of Search ..... 60/646, 657, 653, 654, 60/679

[56] References Cited

U.S. PATENT DOCUMENTS 4,693,086 9/1987 Hoizumi et al. ..... 60/679 X
4,744,723 5/1988 Hashimoto et al. ..... 60/646 X

FOREIGN PATENT DOCUMENTS 58-38305 3/1983 Japan .
59-26765 6/1984 Japan .

OTHER PUBLICATIONS

Johnson et al., "An Integrated Turbine Bypass System," Proceedings of the American Power Conference, vol. 43, 6/1981, pp. 130–141.

*Primary Examiner*—Allen M. Ostrager
*Attorney, Agent, or Firm*—Foley & Lardner, Schwartz, Jeffery, Schwaab, Mack, Blumenthal & Evans

[57] ABSTRACT

A steam turbine plant comprising: (a) first, second and third turbines which are coaxially combined with each other; (b) a boiler for supplying high pressure steam to the first turbine; (c) first, second and third bypass means for selectively bypassing steam around the first, second and third turbines, respectively, wherein each of the bypass means comprises means for cooling the steam; (d) a condenser for condensing steam discharged from the third turbine; (e) means for forming a vacuum in the condenser; (f) a first reheater for reheating steam discharged from the first turbine and out of the first bypass means and supplying the steam to the second turbine; (g) a second reheater for reheating steam discharged from the second turbine and from the second bypass means and for supplying the steam to the third turbine; (h) first, second and third control valves for controlling steam flow rates flowing into the first, second and third turbines, respectively; (i) first, second and third bypass valves for controlling flow rates of the first, second and third bypass means, respectively; and (j) means for selectively forming a vacuum in at least one of the first and second turbines.

19 Claims, 3 Drawing Sheets

STEAM TURBINE PLANT

BACKGROUND OF THE INVENTION

1. Field of the Invention

This invention relates to a steam turbine plant, and more particularly to a steam turbine plant with at least three coaxially combined turbines and two reheaters.

2. Description of the Prior Art

Very high pressure turbine plants using very high pressure and high temperature steam are being developed. The steam pressure may be as high as 316 kg/cm$^2$ g and the steam temperature, 593° C. Such a turbine plant typically has very high pressure (VHP), high pressure (HP), intermediate pressure (IP) and low pressure (LP) turbines which are coaxially combined. It also has first and second reheaters (RHs). The first RH reheats steam discharged from the VHP turbine and supplies the reheated steam to the HP turbine. The second RH reheats steam discharged from the HP turbine and supplies the reheated steam to the IP turbine.

The steam discharged from the IP turbine is then supplied to the LP turbine. The steam discharged from the LP turbine is condensed in a condenser, and the condensed water is supplied to a boiler which generates VHP steam to be supplied to the VHP turbine.

The start-up procedure of such a turbine plant is very complicated and time-consuming, because abrupt heating-up of the turbine rotor and/or casing inlet portion or metal-steam temperature mismatching give thermal shock to the rotor and/or casing inlet portion and may cause damage to them. Furthermore, the fuel burning rate in the boiler cannot be smaller than a certain minimum value—typically 20 to 30% of the rated value in case of a coal burning boiler—to obtain a stable condition of the burner for the boiler.

A turbine bypass system is disclosed in a report entitled "An Integrated Turbine Bypass System" (Volume 43, *Proceedings of the American Power Conference,* 1981, Pages 130–141). Such a bypass system can be used to start up a turbine plant, for example, with a VHP turbine, an HP turbine, an IP-LP turbine and two reheaters. In such a turbine plant, the steam from the boiler is bypassed around the VHP turbine through a VHP bypass valve, the steam from the first reheater is bypassed around the HP turbine through an HP bypass valve, and the steam from the second reheater is bypassed around the IP-LP turbine through an LP bypass valve before the turbines rotate. Then a main steam control valve at the VHP turbine inlet, a first reheat steam control valve at the HP turbine inlet, a second reheat steam control valve at the IP turbine inlet are gradually opened to rotate the turbines. The VHP bypass valve, the HP bypass valve and the LP bypass valve are simultaneously closed to keep the pressure upstream of these bypass valves at certain values.

The steam remaining in the VHP turbine, however, can be excessively heated up because of gaseous friction which turns into thermal energy. The gaseous friction is especially large in a plant using very high pressure steam.

An appropriate flow rate of steam in the turbine can give a cooling effect to the turbine blades. It is, however, difficult to control all of the flow rates of all of the turbines and the turbine rotation, limiting the maximum metal temperature and minimizing metal-steam temperature mismatch.

SUMMARY OF THE INVENTION

An object of this invention is to provide a steam turbine plant which has at least three coaxial turbines and two reheaters and which can be started up without excessive metal steam mismatch or excessive metal heat-up.

Another object of this invention is to provide a method of starting up a steam turbine plant with three coaxial turbines and two reheaters, wherein the plant can be started up without excessive metal-steam mismatch or excessive metal heat-up.

According to one aspect of the invention, there is provided a steam turbine plant comprising: (a) first, second and third turbines which are coaxially combined with each other; (b) a boiler for supplying high pressure steam to the first turbine; (c) first, second and third bypass means for selectively bypassing steam around the first, second and third turbines, respectively, wherein each of the bypass means comprises means for cooling the steam; (d) a condenser for condensing steam discharged from the third turbine; (e) means for forming a vacuum in the condenser; (f) a first reheater for reheating steam discharged from the first turbine and from the first bypass means and for supplying the steam to the second turbine; (g) a second reheater for reheating steam discharged from the second turbine and from the second bypass means and for supplying the steam to the third turbine; (h) first, second and third control valves for controlling steam flow rate flowing into the first, second and third turbines, respectively; (i) first, second and third bypass valves for controlling flow rates of the first, second and third bypass means, respectively; and (j) means for selectively forming a vacuum in at least one of the first and second turbines.

According to another aspect of the invention, there is provided a method of starting up a steam turbine plant, the plant comprising coaxially combined first, second and third turbines, a boiler for supplying high pressure steam to the first turbine, a first bypass line for bypassing steam around the first turbine, a second bypass line for bypassing steam around the second turbine, a third bypass line for bypassing steam around the third turbine, a first reheater for reheating steam discharged from the first turbine and from the first bypass line and for supplying the steam to the second turbine, a second reheater for reheating steam discharged from the second turbine and from the second bypass line and for supplying the steam to the third turbine, and a condenser for condensing steam: the method comprising the steps of: (a) forming a vacuum in the condenser; (b) selectively forming a vacuum in at least one of the first and second turbines; (c) supplying part of the steam discharged from the second reheater to the third turbine to rotate the first, second and third turbines, while bypassing the rest of the steam discharged from the second reheater through the third bypass line to the condenser; (d) subsequently, disconnecting one of the first and second turbines from the condenser; and (e) subsequently supplying steam to all the turbines.

Further objects, features and advantages of the present invention will become apparent from the detailed description of the preferred embodiments that follows, when considered with the attached drawings.

BRIEF DESCRIPTION OF THE DRAWINGS

The accompanying drawings, which are incorporated into and constitute a part of this specification, illustrate embodiments of the invention and together with the description, serve to explain the principles of the invention. In the drawings.

DETAILED DESCRIPTION OF THE PREFERRED EMBODIMENTS

Figure 1:
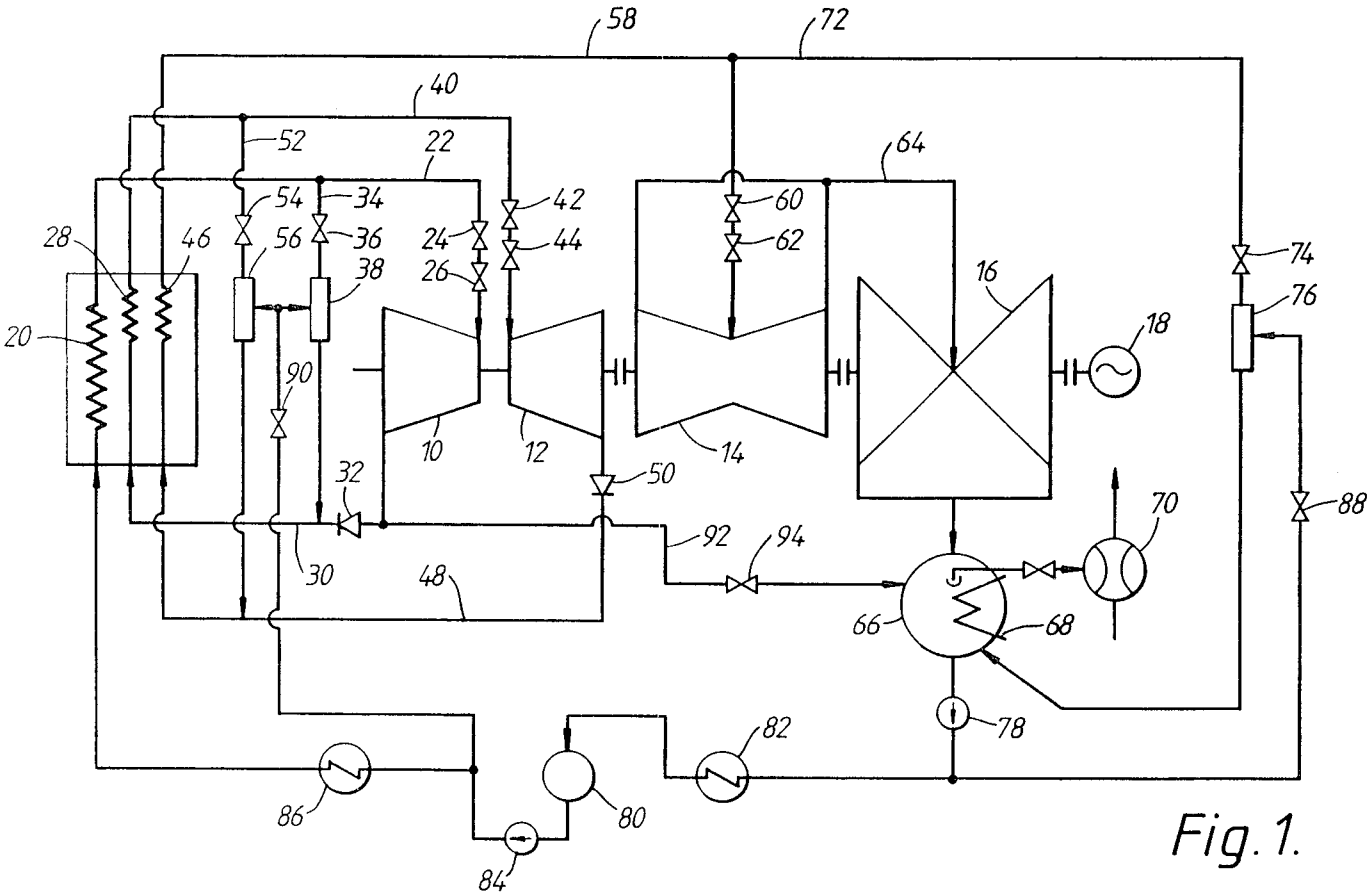
FIG. 1 is a schematic diagram of a first embodiment of this invention.

The first embodiment of this invention of a steam turbine plant will now be described below, referring to FIG. 1.

A very high pressure (VHP) turbine 10, a high pressure (HP) turbine 12, an intermediate pressure (IP) turbine 14, a low pressure (Lp) turbine 16 and an electric power generator 18 are coaxially combined.

A boiler 20 supplies very high pressure steam or main steam to the VHP turbine 10 via a main steam (MS) line 22. An MS stop valve 24 and an MS control valve 26 are provided on the MS line 22. Steam discharged from the VHP turbine 10 is led to a first reheater (RH) 28 via a first RH low temperature line 30, where a first RH check valve 32 is provided. A VHP turbine bypass line 34 is branched from the MS line 22 upstream of the MS stop valve 24, and is connected downstream of the first RH check valve 32 on the first RH low temperature line 30. A VHP turbine bypass valve 36 and a VHP temperature reducer 38 are provided on the VHP turbine bypass line 34.

Reheated steam discharged from the first RH 28 is led to the HP turbine 12 via a first RH high temperature line 40. A first RH steam stop valve 42 and a first RH steam control valve 44 are provided on the first RH high temperature line 40. Steam discharged from the HP turbine 12 is led to a second RH 46 via a second RH low temperature line 48, where a second RH check valve 50 is provided. An HP turbine bypass line 52 is branched from the first RH high temperature line 40 upstream of the first RH steam stop valve 42, and is connected downstream of the second RH check valve 50 on the second RH low temperature line 48. An HP turbine bypass valve 54 and a HP temperature reducer 56 are provided on the HP turbine bypass line 52.

Reheated steam discharged from the second RH 46 is led to the IP turbine 14 via a second RH high temperature line 58. A second RH steam stop valve 60 and a second RH steam control valve 62 are provided on the second RH high temperature line 58. Steam discharged from the IP turbine 14 is then led to the LP turbine 16 via a low temperature steam line 64. Steam discharged from the LP turbine 16 is led to a condenser 66 which is cooled by cooling water 68 such as sea water and is connected to an ejector 70 for forming a vacuum there. The steam is condensed into water in the condenser 66. An IP-LP turbine bypass line 72 is branched from the second RH high temperature line 68 upstream of the second RH steam stop valve 60, and is connected to the condenser 66 via an IP-LP turbine bypass valve 74 and an IP-LP temperature reducer 76.

The water condensed in the condenser 66 is pumped up by a condensate pump 78 to a de-aerator 80 via a low pressure feed water heater 82. Water discharged from the de-aerator 80 is pumped up by a feed water pump 84 and fed to the boiler 20 via a high pressure feed water heater 86.

Part of the condensed water discharged from the condensate pump 78 is branched via a first temperature reducer valve 88 to the IP-LP temperature reducer 76, and part of the feed water discharged from the feed water pump 84 is branched via a second temperature reducer valve 90 to the VHP temperature reducer 38 and the HP temperature reducer 56.

A VHP turbine dump line 92 is branched from upstream of the first RH check valve 32 on the first RH low temperature line 30 via a VHP turbine dump valve 94 to the condenser 66.

Start-up operation of the steam turbine plant described above is as follows:

(1) A vacuum is first formed in the condenser 66 by activating the ejector 70. When the degree of vacuum (atmospheric pressure minus absolute pressure) has reached a certain value—typically 600 mmHg—, the VHP turbine bypass valve 36, the HP turbine bypass valve 54, the IP-LP turbine bypass valve 74 and the VHP turbine dump valve 94 are opened. The steam generated in the boiler 20 flows through the MS line 22 and the VHP turbine bypass line 34 to the VHP temperature reducer 38. The steam cooled in the VHP temperature reducer 38 is led to the first RH 28 via the first RH low temperature line 30. The first RH check valve 32 prevents the main steam from flowing to the VHP turbine 10 or to the condenser 66.

The steam cooled in the VHP temperature reducer 38 is then reheated in the first RH 28. The reheated steam is then led through the first RH high temperature line 40 and the HP turbine bypass line 52 to the HP temperature reducer 56. The reheated steam is cooled there, and is led to the second RH 46 via the second RH low temperature line 48. The second RH check valve 50 prevents the cooled steam from flowing to the HP turbine 12

The cooled steam is reheated again in the second RH 46. The reheated steam is then led through the second RH high temperature line 58 and the IP-LP turbine bypass line 72 to the IP-LP temperature reducer 76. The steam is cooled there and led to the condenser 66.

During the process described above, the MS stop valve 24, the first and second RH steam stop valves 42 and 60 are fully open, and the MS control valve 26 and the first and second RH steam control valves 44 and 62 are fully closed. The valves 24, 26, 42, 44, 60 and 62 are pre-heated then. A vacuum is formed in the VHP turbine 10 because the VHP turbine dump valve 94 is open.

(2) Subsequently, the first and second RH steam control valves 44 and 62 are opened gradually. Part of the steam reheated in the first RH 28 is led through the first RH steam control valve 44 to the HP turbine 12, and the HP turbine 12 is driven to rotate.

In case of a cold start, when the metal is cold, the MS control valve 26 is slightly opened at this time so that a small amount of the main steam flows into the VHP turbine 10 to warm up the entrance region of the VHP turbine 10, and the metal steam temperature mismatch in the VHP turbine 10 is minimized in the step (3) described below. In case of a hot start, when the metal is hot, the MS control valve 26 is kept closed at this time.

In accordance with the opening of the first RH steam control valve 44, the rotation rate increases, and the back pressure of the HP turbine 12 increases, which makes the second RH check valve 50 open.

The steam which has expanded in the HP turbine 12 is led to the second RH low temperature line 48 and it is mixed with the steam which has been cooled in the HP temperature reducer 56. The steam is then reheated again in the second RH 46. Part of the steam reheated in the second RH 46 is led through the second RH steam control valve 62 to the IP turbine 14 and then to the LP turbine 16, while the rest of the steam is led to the condenser 66 through the IP-LP turbine bypass line 72. At that time, the IP-LP turbine bypass valve 74 is partly closed corresponding to the flow rate of the second RH steam introduced to the IP turbine 14. The steam which expands in the HP, IP and LP turbines 12, 14 and 16 drives the turbines to rotate.

During the procedure described above, the rotation rate of the turbines 10, 12, 14 and 16 gradually increases, and the metal temperatures and thermal expansions of the HP, IP and LP turbines 12, 14 and 16 are precisely measured and carefully controlled. Since the VHP turbine 10 is subject to a vacuum and free from gaseous friction, it does not need to be watched, and the number of items which need to be watched is reduced compared with the prior art.

(3) Subsequently, the MS control valve 26 is gradually opened, and the VHP turbine dump valve 94 is fully closed. Part of the main steam out of the boiler 20 flows via MS control valve 26 to the VHP turbine 10, and the VHP turbine 10 is driven to rotate.

In accordance with the opening of the MS control valve 26, the steam flow rate of the VHP turbine 10 and its back pressure increase, which makes the first RH check valve 32 fully open.

The steam which has expanded in the VHP turbine 10 is led to the first RH low temperature line 30 and it is mixed with the steam which has been cooled in the VHP temperature reducer 38. The steam is then repeated in the first RH 28. Part of the steam reheated in the first RH 28 is led to the HP turbine 12 through the first RH steam control valve 44, while the rest of the steam is led the HP turbine bypass line 52. The steam then flows to the second RH 46 and to the IP and LP turbines 14 and 16 or to the IP-LP turbine bypass line 72 as in step (2) described above.

During this process of leading steam to the VHP turbine 10, the metal temperature and thermal expansion of only the VHP turbine 10 needs to be carefully observed, because the other turbines 12, 14 and 16 are heated up very gradually in accordance with the slowly rising temperature of the steam.

(4) Subsequently, the MS control valve 26 and the first and second RH steam valves 44 and 62 are further opened while the VHP, HP and IP-LP turbine bypass valves 36, 54 and 74 are closed. Normal operation condition is then reached.

Figure 2:
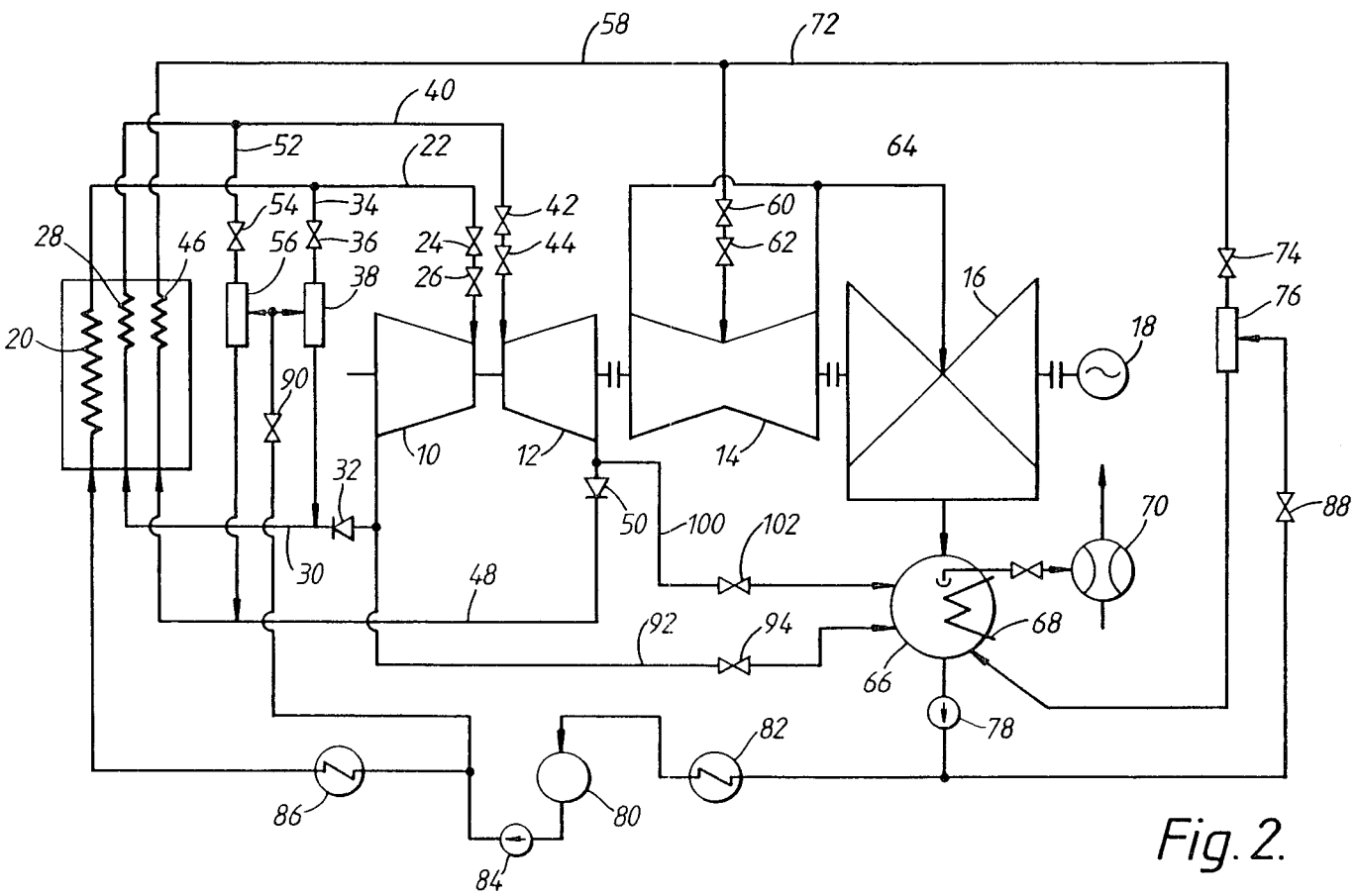
FIG. 2 is a schematic diagram of a second embodiment of this invention.

The second embodiment of the invention will now be described below, referring to FIG. 2. The elements common to the first embodiment described above are assigned the same numerals, and their detailed description is omitted.

An HP turbine dump line 100 with an HP turbine dump valve 102 is added. The HP turbine dump line 100 connects upstream of the second RH check valve 50 on the second RH low temperature line 48 and leads to the condenser 66.

The start-up operation of this steam turbine plant is as follows:

(1) A vacuum is first formed in the condenser 66 by activating the ejector 70. When the degree of vacuum has reached a certain value—typically 600 mmHg—, the VHP turbine bypass valve 36, the HP turbine bypass valve 54, the IP-LP turbine bypass valve 74, the VHP turbine dump valve 94 and the HP turbine dump valve 102 are opened. The steam generated in the boiler 20 flows through the MS line 22 and VHP turbine bypass line 34 to the VHP temperature reducer 38. The steam cooled in the VHP temperature reducer 38 is led to the first RH 28 via the first RH low temperature line 30. The first RH check valve 32 prevents the main steam from flowing to the VHP turbine 10 or to the condenser 66.

The steam cooled in the VHP temperature reducer 38 is then reheated in the first RH 28. The reheated steam is then led through the first RH high temperature line 40 and the HP turbine bypass line 52 to the HP temperature reducer 56. The reheated steam is cooled there, and is led to the second RH 46 via the second RH low temperature line 48. The second RH check valve 50 prevents the cooled steam from flowing to the HP turbine 12 or to the condenser 66.

The cooled steam is reheated again in the second RH 46. The reheated steam is then led through the second RH high temperature line 58 and the IP-LP turbine bypass line 72 to the IP-LP temperature reducer 76. The steam is cooled there and led to the condenser 66.

During the process described above, the MS stop valve 24, the first and second RH steam stop valves 42 and 60 are fully open, and the MS control valve 26 and the first and second RH steam control valves 44 and 62 are fully closed. The valves 24, 26, 42, 44, 60 and 62 are pre-heated then. A vacuum is formed in the VHP and HP turbines 10 and 12 because the VHP and HP turbine dump valves 94 and 102 are open.

(2) Subsequently, the second RH steam control valve 62 is opened gradually. Part of the steam reheated in the second RH 46 is led through the second RH steam control valve 62 to the IP turbine 14, and the IP turbine 14 is driven to rotate.

In case of a cold start, when the metal is cold, the MS control valve 26 and the first RH steam control valve 44 are slightly opened at this time so that a small amount of the steam flows into the VHP and HP turbines 10 and 12 to warm up the entrance regions of the VHP and HP turbines 10 and 12, and the metal steam temperature mismatch in the VHP and HP turbines 10 and 1 is minimized in step (3) described below. In case of a hot start, when the metal is hot, the MS control valve 26 and the first RH steam control valve 44 are kept closed at this time.

The steam which has expanded in the IP turbine 14 is then led to the LP turbine 16.

The residual part of the steam reheated in the second RH 46 which does not go through the IP turbine 14 is led to the condenser 66 through the IP-LP turbine bypass line 72. At that time, the IP-LP turbine bypass valve 74 is partly closed corresponding to the flow rate of the second RH steam introduced to the IP turbine 14. The steam which expands in the IP and LP turbines 14 and 16 drives the turbines to rotate.

During the procedure described above, the rotation rate of the turbines 10, 12, 14 and 16 gradually increases, and the metal temperatures and thermal expansions of the IP and LP turbines 14 and 16 are precisely measured and carefully controlled. Since the VHP and HP turbines 10 and 12 are subjected to a vacuum and free from gaseous friction, they do not need to be watched, and the number of items which need to be watched is further reduced compared with the first embodiment.

(3) Subsequently, the MS control valve 26 and the first RH steam control valve 44 are gradually opened, and the VHP and HP turbine dump valves 94 and 102 are fully closed. Part of the main steam out of the boiler 20 flows via the MS control valve 26 to the VHP turbine 10, which drives the VHP turbine 10, to rotate.

In accordance with the opening of the MS control valve 26, the steam flow rate of the VHP turbine 10 and its back pressure increase, which makes the first RH check valve 32 fully open.

The steam which has expanded in the VHP turbine 10 is led to the first RH low temperature line 30 and it is mixed with the steam cooled in the VHP temperature reducer 38. The steam is then reheated in the first RH 28. Part of the steam reheated in the first RH 28 is led to the HP turbine 12 through the first RH steam control valve 44, while the rest of the steam is led to the HP turbine bypass line 52.

In accordance with the opening of the first RH steam control valve 44, the steam flow rate of the HP turbine 12 and its back pressure increases, which makes the second RH check valve 50 fully open.

The steam which has expanded in the HP turbine 12 is led to the second RH low temperature line 48 and it is mixed with the steam cooled in the HP temperature reducer. The steam is then reheated in the second RH 46.

The steam discharged from the second RH 46 is led to the IP-LP turbines 14 and 16 or to the IP-LP turbine bypass line 72 as in the step (2) described above.

During this process of leading steam to the VHP and HP turbines 10 and 12, the metal temperature and thermal expansion of only the VHP and HP turbines 10 and 12 needs to be carefully observed, because the other turbines 14 and 16 are heated up very gradually in accordance with the slowly rising temperature of the steam.

(4) Subsequently, the MS control valve 26 and the first and second RH steam valves 44 and 62 are further opened while the VHP, VP and IP-LP turbine bypass valves 36, 54 and 74 are closed. Normal operation condition is then reached.

Figure 3:
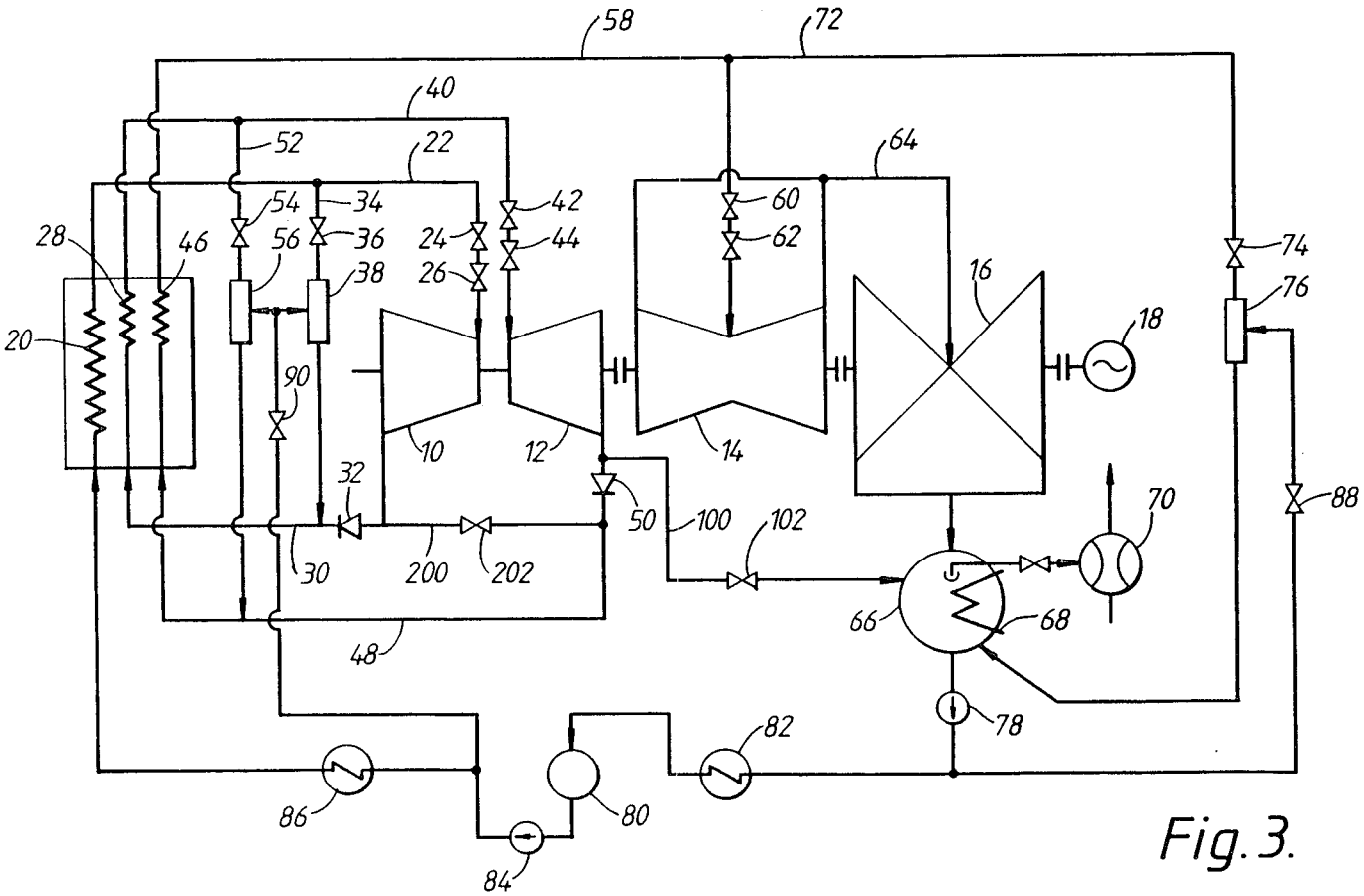
FIG. 3 is a schematic diagram of a third embodiment of this invention.

The third embodiment of the invention will now be described below, referring to FIG. 3. The elements common to the first and second embodiments described above are assigned the same numerals and their detailed description is omitted.

An HP turbine dump line 100 with the HP turbine dump valve 102 is provided as in the second embodiment. The HP turbine dump line 100 connects upstream of the second RH check valve 50 on the second RH low temperature line 48 and leads to the condenser 66. The VHP turbine dump line 92 with the VHP turbine dump valve 94 is eliminated from this embodiment, in contrast to the first and second embodiments. A connecting line 200 connects upstream of the first RH check valve 32 and downstream of the second RH check valve 50, via a connecting valve 202.

The start-up operation of this steam turbine plant is as follows:

(b 1) A vacuum is first formed in the condenser 66 by activating the ejector 70. When the degree of vacuum has reached a certain value—typically 600 mmHg—, the VHP turbine bypass valve 36, the HP turbine bypass valve 54, the IP-LP turbine bypass valve 74, the HP turbine dump valve 102 and the connecting valve 202 are opened. The steam generated in the boiler 20 flows through the MS line 22 and the VHP turbine bypass line 34 to the VHP temperature reducer 38. The steam cooled in the VHP temperature reducer 38 is led to the first RH 28 via the first RH low temperature line 30. The first RH check valve 32 prevents the main steam from flowing to the VHP turbine 10.

The steam cooled in the VHP temperature reducer 38 is then reheated in the first RH 28. The reheated steam is then led through the first RH high temperature line 40 and the HP turbine bypass line 52 to the HP temperature reducer 56. The reheated steam is cooled there and is led to the second RH 46 via the second RH low temperature line 48. The second RH check valve 50 prevents the cooled steam from flowing to the HP turbine 12 and to the condenser 66.

The cooled steam is reheated again in the second RH 46. The reheated steam is then led through the second RH high temperature line 58 and the IP-LP turbine bypass line 72 to the IP-LP temperature reducer 76. The steam is cooled there and led to the condenser 66.

During the process described above, the MS stop valve 24, the first and second RH steam stop valves 42 and 60 are fully open, and the MS control valve 26 and the first and second RH steam control valves 44 and 46 are fully closed. The valves 24, 26, 42, 44, 60, and 62 are heated then. A vacuum is formed in the HP turbine 12 because HP turbine dump valve 102 is open. Since the connecting valve 202 is open, the pressure in the VHP turbine 10 is balanced with that in the second RH 46.

(2) Subsequently, the MS control valve 26 and the second RH steam control valve 62 are opened gradually. Part of the main steam is led through the MS control valve 26 to the VHP turbine 10, which drives the VHP turbine 10, to rotate.

In case of a cold start, when the metal is cold, the first RH steam control valve 44 is slightly opened at this time so that a small amount of the steam flows into the HP turbine 12 to warm up the entrance region of the HP turbine 12, and the metal steam temperature mismatch in the HP turbine 12 is minimized in the step (3) described below. In case of a hot start, when the metal is hot, the first RH steam control valve 44 is kept closed at this time.

The steam which has expanded in the VHP turbine 10 is led to the second RH 46 via the connecting line 200 and the second RH low temperature line 48.

Part of the steam reheated in the second RH 46 is led through the second RH steam control valve 62 to the IP turbine 14 and then to the LP turbine 16.

The residual part of the steam reheated in the second RH 46 which does not go to the IP turbine 14 is led to the condenser 66 through the IP-LP turbine bypass line 72. At that time, the IP-LP turbine bypass valve 74 is partly closed corresponding to the flow rate of the second RH steam introduced to the IP turbine 14. The steam which expands in the IP and LP turbines 14 and 16 drives the turbines to rotate.

During the procedure described above, the rotation rate of the turbines 10, 12, 14 and 16 gradually increases, and the metal temperatures and thermal expansions of the VHP, IP and LP turbines 10, 14 and 16 are precisely measured and carefully controlled. Since the HP turbine 12 is subjected to a vacuum and free from gaseous friction, it does not need to be watched, and the number of items which need to be watched is reduced compared with the prior art.

(3) Subsequently, the first RH steam control valve 44 is gradually opened, and the HP turbine dump valve 102 is fully closed. Part of the steam reheated in the first RH 28 flows via the first RH steam control valve 44 to the HP turbine 12, which drives the HP turbine 12 to rotate.

In accordance with the opening of the first RH steam control valve 44, the steam flow rate of the HP turbine 12 and its back pressure increase, which makes the second RH check valve 50 fully open. The steam which has expanded in the HP turbine 12 is led to the second RH low temperature line 48 and it is mixed there with the steam which has expanded in the VHP turbine 10.

The steam is then reheated in the second RH 46. Part of the steam reheated in the second RH 46 is led to the IP turbine 14 through the second RH steam control valve 62, while the rest of the steam is led to the IP-LP turbine bypass line 72.

During this process of leading steam to the HP turbine 12, the metal temperature and thermal expansion of only the HP turbine 12 needs to be carefully observed, because the other turbines 10, 14 and 16 are heated up very gradually in accordance with the slowly rising temperature of the steam.

(4) Subsequently, the connecting valve 202 is fully closed. Consequently, the pressures in the VHP turbine 10 and at the outlet of the VHP turbine 10 rise rapidly. The first RH check valve 32 is then opened, and the steam which has expanded in the VHP turbine 10 is led to the first RH 28 together with the steam discharged from the VHP turbine bypass line 34.

Part of the steam reheated in the first RH 46 is led to the HP turbine 12, and the rest is led to the HP turbine bypass line 52. All the steam is then led to the second RH 16 and to the IP and LP turbines 14 and 16 or to the IP-LP turbine bypass line 72 as in the step (3) described above.

(5) Subsequently, the MS control valve 26 and the first and second RH steam valves 44 and 62 are further opened while the VHP, HP and IP-LP turbine bypass valves 36, 54 and 74 are closed. Normal operation condition is then reached.

What is claimed is:

1. A steam turbine plant comprising:

(a) first, second and third turbines which are coaxially combined with each other;

(b) a boiler for supplying high pressure steam to the first turbine;

(c) first, second and third bypass means for selectively bypassing steam around the first, second and third turbines, respectively, wherein each of said bypass means comprises means for cooling the steam;

(d) a condenser for condensing steam discharged from the third turbine;

(e) means for forming a vacuum in the condenser;

(f) a first reheater for reheating steam discharged from the first turbine and from the first bypass means and for supplying the steam to the second turbine;

(g) a second reheater for reheating steam discharged from the second turbine and from the second bypass means and for supplying the steam to the third turbine;

(h) first, second and third control valves for controlling steam flow rates flowing into the first, second and third turbines, respectively;

(i) first, second and third bypass valves for controlling flow rates in said first, second and third bypass means, respectively; and (j) means for selectively forming a vacuum in at least one of the first and second turbines.

2. A steam turbine plant according to claim 1, wherein said selective vacuum forming means comprises:

means for selectively connecting an outlet of the first turbine to the condenser.

3. A steam turbine plant according to claim 1, wherein said selective vacuum forming means comprises:

means for selectively connecting an outlet of the second turbine to the condenser.

4. A steam turbine plant according to claim 2, wherein said selective vacuum forming means further comprises:

means for selectively connecting an outlet of the second turbine to the condenser.

5. A steam turbine plant according to claim 1, further comprising:

means for selectively connecting outlets of the first and second turbines to each other.

6. A steam turbine plant according to claim 5, further comprising:

means for disconnecting the outlet of the first turbine and the first reheater from each other when the outlets of the first and second turbines are connected to each other and a vacuum is formed in the second turbine.

7. A steam turbine plant according to claim 1, wherein the boiler comprises a burner for burning coal.

8. A steam turbine plant according to claim 1, further comprising:

means for supplying a small amount of steam to said at least one of the first and second turbines where a vacuum is formed, for warming an entrance region of said at least one of the first and second turbines.

9. A steam turbine plant according to claim 1, further comprising a fourth turbine coaxially combined with said first, second and third turbines.

10. A method of starting up a steam turbine plant, the plant comprising coaxially combined first, second and third turbines, a boiler for supplying high pressure steam to the first turbine, a first bypass line for bypassing steam around the first turbine, a second bypass line for bypassing steam around the second turbine, a third bypass line for bypassing steam around the third turbine, a first reheater for reheating steam discharged from the first turbine and from the first bypass line and for supplying the steam to the second turbine, a second reheater for reheating steam discharged from the second turbine and from the second bypass line and for supplying the steam to the third turbine, and a condenser for condensing steam discharged from the third turbine;

the method comprising the steps of:

(a) forming a vacuum in the condenser;

(b) selectively forming a vacuum in at least one of the first and second turbines by selectively connecting said at least one of the first and second turbines to the condenser;

(c) supplying a first portion of the steam discharged from the second reheater to the third turbine to rotate the first, second and third turbines, while bypassing a second portion of the steam discharged from the second reheater through the third bypass line to the condenser;

(d) subsequently, disconnecting said one of the first and second turbines from the condenser; and (e) supplying steam to all the turbines.

11. A method according to claim 10, wherein the step of forming a vacuum in at least one of the first and second turbines comprises steps of:

leading substantially all steam supplied by the boiler to the first bypass line; and connecting an outlet of the first turbine to the condenser.

12. A method according to claim 10, wherein the step of forming a vacuum in at least one of the first and second turbines comprises the steps of:

leading substantially all steam supplied by the first reheater to the second bypass line; and connecting an outlet of the second turbine to the condenser.

13. A method according to claim 11, wherein the step of forming a vacuum in at least one of the first and second turbines further comprises the steps of:

leading substantially all steam supplied by the first reheater to the second bypass line; and connecting an outlet of the second turbine to the condenser.

14. A method according to claim 10, further comprising the steps of:

selectively connecting to each other outlets of the first and second turbines, while forming a vacuum in at least one of the first and second turbines; and subsequently, selectively disconnecting the outlets of the first and second turbines from each other.

15. A method according to claim 14, further comprising the step of:

selectively disconnecting the outlet of the first turbine and the first reheater from each other when the outlets of the first and second turbines are connected to each other and a vacuum is formed in the second turbine.

16. A method according to claim 10, wherein the boiler comprises a burner for burning coal.

17. A method according to claim 10, further comprising the step of supplying a small amount of steam to said at least one of the first and second turbines in which a vacuum is formed, to warm up said entrance region of said at least one of the first and second turbines.

18. A method of starting up a steam turbine plant, the plant comprising coaxially combined first, second and third turbines, a boiler for supplying high pressure steam to the first turbine, a first bypass line for bypassing steam around the first turbine, a second bypass line for bypassing steam around the second turbine, a third bypass line for bypassing steam around the third turbine, a first reheater for reheating steam discharged from the first turbine and from the first bypass line and for supplying the steam to the second turbine, a second reheater for reheating steam discharged from the second turbine and from the second bypass line and for supplying the steam to the third turbine, and a condenser for condensing steam discharged from the third turbine;

the method comprising the steps of:

(a) forming a vacuum in the condenser;

(b) selectively forming a vacuum in the first turbine by selectively connecting the first turbine to the condenser;

(c) bypassing substantially all steam discharged from the boiler through the first bypass line to the first reheater;

(d) supplying a first portion of the steam discharged from the first reheater to the second turbine, while bypassing a second portion of said steam discharged from the first reheater through the second bypass line to the second reheater;

(e) supplying a first portion of the steam discharged from the second reheater to the third turbine, while bypassing a second portion of said steam discharged from the second reheater through the second bypass line to the condenser;

(f) subsequently, supplying a first portion of the steam discharged from the first reheater to the second turbine, while bypassing a second portion of the steam discharged from the first reheater through the second bypass line to the second reheater;

(g) subsequently, disconnecting the first turbine and the condenser; and (h) supplying a first portion of the steam discharged from the boiler to the first turbine, while bypassing a second portion of the steam discharged from the boiler through the first bypass line to the first reheater.

19. A method of starting up a steam turbine plant, the plant comprising coaxially combined first, second and third turbines, a boiler for supplying high pressure steam to the first turbine, a first bypass line for bypassing steam around the first turbine, a second bypass line for bypassing steam around the second turbine, a third bypass line for bypassing steam around the third turbine, a first reheater for reheating steam discharged from the first turbine and from the first bypass line and for supplying the steam to the second turbine, a second reheater for reheating steam discharged from the second turbine and from the second bypass line and for supplying the steam to the third turbine, and a condenser for condensing steam discharged from the third turbine:

the method comprising the steps of:

(a) forming a vacuum in the condenser;

(b) selectively forming a vacuum in the second turbine by selectively connecting the second turbine to the condenser;

(c) supplying a first portion of the steam discharged from the boiler to the first turbine while leading a second portion of the steam discharged from the boiler to the first reheater through the first bypass line;

(d) bypassing substantially all steam discharged from the first reheater through the second bypass line to the second reheater;

(e) leading all steam discharged from the first turbine to the second reheater;

(f) supplying a first portion of the steam discharged from the second reheater to the third turbine, while bypassing a second portion of said steam discharged from the second reheater through the second bypass line to the condenser;

(g) subsequently, leading all steam discharged from the first turbine to the first reheater;

(h) selectively disconnecting the second turbine from the condenser; and (i) supplying a first portion of the steam of the discharged from the first reheater to the second turbine, while bypassing a second portion of the steam discharged from the first reheater through the second bypass line to the second reheater.

* * * * *